US007716881B2

(12) United States Patent
Tsai

(10) Patent No.: US 7,716,881 B2
(45) Date of Patent: May 18, 2010

(54) SHOCK SUPPRESSOR

(76) Inventor: Chong-Shien Tsai, 6F-2, No. 5, Lane 466, Minchuan Rd., North Dist., Taichung (TW)

( * ) Notice: Subject to any disclaimer, the term of this patent is extended or adjusted under 35 U.S.C. 154(b) by 1156 days.

(21) Appl. No.: 11/131,209

(22) Filed: May 18, 2005

(65) Prior Publication Data

US 2006/0272225 A1 Dec. 7, 2006

(51) Int. Cl.
*E04H 9/00* (2006.01)
*E04H 9/02* (2006.01)

(52) U.S. Cl. ..... 52/167.1; 52/167.4; 52/1; 248/636

(58) Field of Classification Search ..... 52/167.1, 52/167.4–167.7, 1; 248/636
See application file for complete search history.

(56) References Cited

U.S. PATENT DOCUMENTS 4,320,549 A * 3/1982 Greb ..... 14/73.5
6,085,473 A * 7/2000 Teramachi et al. ..... 52/167.5
6,164,022 A * 12/2000 Ishikawa et al. ..... 52/167.5
6,321,492 B1 * 11/2001 Robinson ..... 52/167.1
6,505,806 B1 * 1/2003 Glaesener ..... 248/638
6,631,593 B2 * 10/2003 Kim ..... 52/167.9
6,688,051 B2 * 2/2004 Tsai ..... 52/167.4
6,725,612 B2 * 4/2004 Kim ..... 52/167.5
6,862,849 B2 * 3/2005 Kim ..... 52/167.9
7,237,364 B2 * 7/2007 Tsai ..... 52/167.6
2002/0166296 A1 * 11/2002 Kim ..... 52/167.5
2006/0000159 A1 * 1/2006 Tsai ..... 52/167.4
2006/0048462 A1 * 3/2006 Huang et al. ..... 52/167.5
2007/0130848 A1 * 6/2007 Tsai ..... 52/167.7
2007/0157532 A1 * 7/2007 Tsai ..... 52/167.1
2008/0078633 A1 * 4/2008 Tsai ..... 188/266
2008/0098671 A1 * 5/2008 Tsai ..... 52/167.6
2008/0120927 A1 * 5/2008 Tsai ..... 52/167.4

* cited by examiner

*Primary Examiner*—Richard E Chilcot, Jr.
*Assistant Examiner*—Elizabeth A Plummer
(74) *Attorney, Agent, or Firm*—Rabin & Berdo, P.C.

(57) ABSTRACT

A shock suppressor has an upper base, a lower base and a connecting device. The upper base has a bottom and a top channel defined in the bottom along a first direction. The lower base corresponds to the upper base and has a top and a bottom channel defined in the top along a second direction corresponding to the first direction of the top channel at an angle. The connecting device is slidably mounted in the top channel and the bottom channel. Accordingly, the shock suppressor can reduce or isolate the transmission of a shock efficiently.

24 Claims, 8 Drawing Sheets

SHOCK SUPPRESSOR

BACKGROUND OF THE INVENTION

1. Field of the Invention

The present invention relates to a shock suppressor for a structure or sensitive equipment, and more particularly to a shock suppressor that can dissipate seismic shock energy efficiently.

2. Description of Related Art

In recent years, the trend for constructing taller and taller buildings has gathered pace. However, the effect of ground motions is a very important factor to be considered in the design of a high building or a skyscraper, from micro-vibrations to catastrophic earthquakes, such as in USA, Taiwan or Japan. Therefore, shock reduction is very important aspect in the construction of a structure or a skyscraper.

In addition, to protect cultural or historical relics, industrial precision instruments, etc, a shock suppressing device is needed.

To overcome the shortcomings, the present invention tends to provide a shock suppressor to mitigate or obviate the aforementioned problems.

SUMMARY OF THE INVENTION

The main objective of the invention is to provide a shock suppressor that can reduce or isolate the transmission of a shock efficiently. The shock suppressor has an upper base, a lower base and a connecting device. The upper base has a lower and a top channel defined in the lower along a first direction. The lower base corresponds to the upper base and has a top and a lower channel defined in the top along a second direction corresponding to the first direction of the top channel at an angle. The connecting device is slidably mounted in the top channel and the lower channel.

Other objects, advantages and novel features of the invention will become more apparent from the following detailed description when taken in conjunction with the accompanying drawings.

DETAILED DESCRIPTION OF PREFERRED EMBODIMENT

Figure 1:
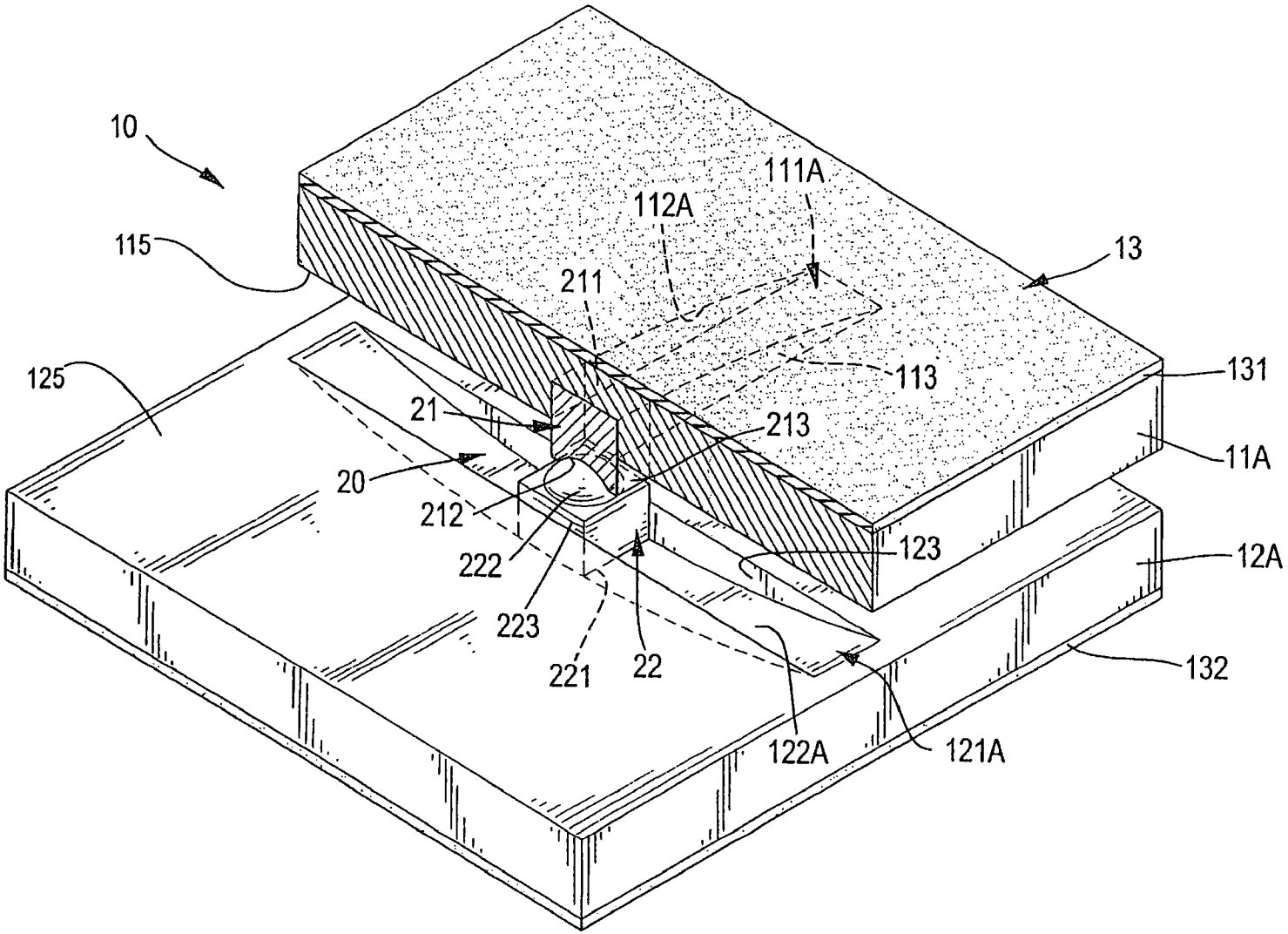
FIG. 1 is a perspective view in partial cross section of a first embodiment of a shock suppressor in accordance with the present invention.
Figure 2:
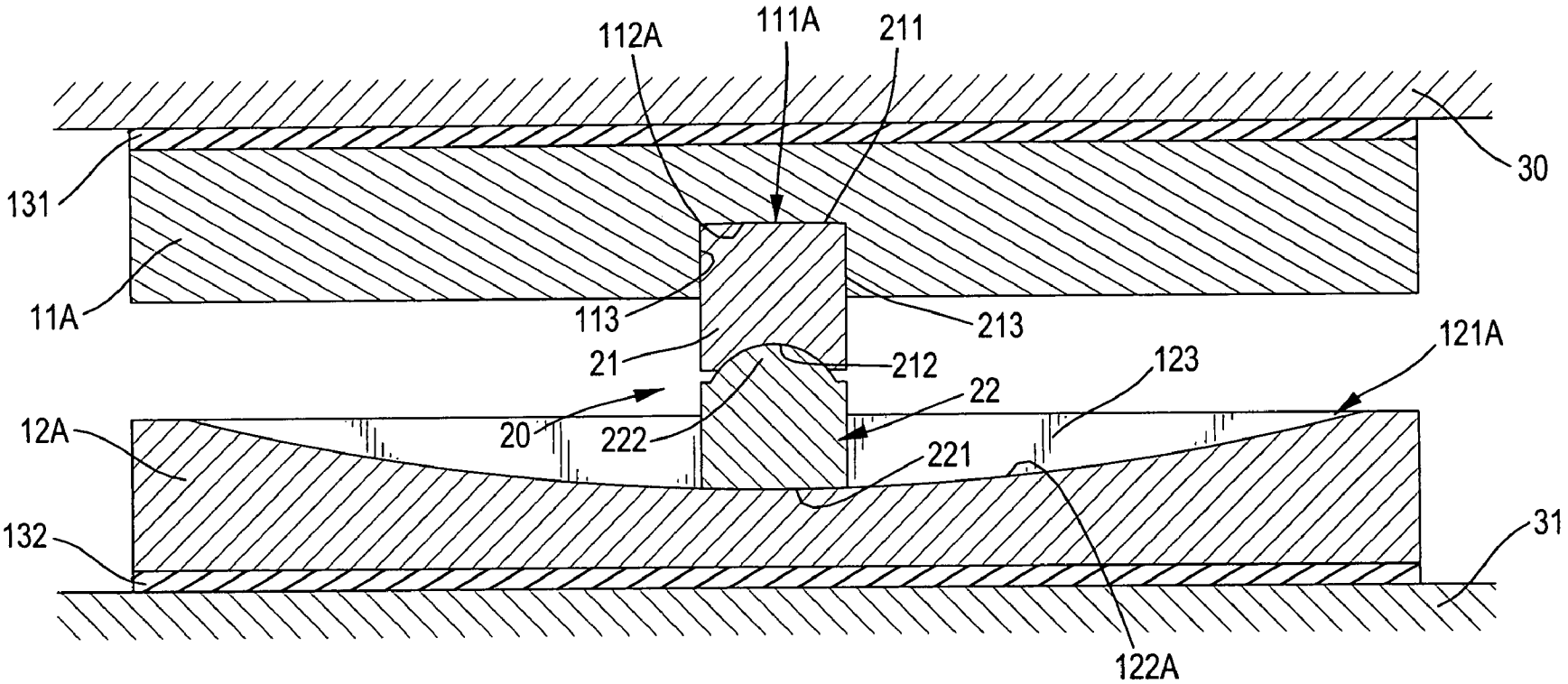
FIG. 2 is a cross sectional side plan view of the first embodiment of the shock suppressor in FIG. 1.

With reference to FIGS. 1 and 2, a first embodiment of a shock suppressor (10) in accordance with the present invention comprises an upper base (11A), a lower base (12A), a connecting device (20) and an optional shock suppressing element (13). The upper base (11A) has a bottom (115) and an upper channel (111A) defined in the bottom (115) along a first direction, wherein the upper base (11A) is adapted to be attached to an object, such as a building (30). The upper channel (111A) has an arcuate face (112A) and two walls (113) perpendicular to the arcuate face (112A).

The lower base (12A) corresponds to the upper base (11A) and is adapted to be attached to the ground (31). The lower base (12A) has a top (125) and a lower channel (121A) defined in the top (125) along a second direction corresponding to the first direction of the upper channel (111A) at an angle. In a preferred embodiment, the second direction of the lower channel (121A) is perpendicular or parallel to the first direction of the upper channel (111A) to make the two channels (111A,121A) respectively serve as X and Y or X and X coordinate axes. The lower channel (121A) has an arcuate surface (122A) and two walls (123) perpendicular to the arcuate surface (122A) of the lower channel (121A).

The connecting device (20) is slidably mounted in the upper channel (111A) and the lower channel (121A). The connecting device (20) comprises an upper slider (21) and a lower slider (22). The upper slider (21) is slidably mounted inside the upper channel (111A) and has a bottom, an arcuate sliding top (211), two sliding surfaces (213) and a hemispheric recess (212). The lower of the upper slider (21) protrudes out from the upper channel (111A). The arcuate sliding top (211) slidably abuts with the arcuate face (112A) of the upper channel (111A). The two sliding surfaces (213) are formed on opposite sides of the upper slider (21) and slidably abut respectively with the walls (113) in the upper channel (111A). The hemispheric recess (212) is defined in the lower of the upper slider (21).

The lower slider (22) is slidably mounted inside the lower channel (121A). The lower slider (22) has a top, an arcuate sliding bottom (221), two sliding surfaces (223) and a hemispheric protrusion (222). The top of the lower slider (22) protrudes from the lower channel (121A) and abuts with the lower of the upper slider (21). The arcuate sliding lower (221) slidably abuts with the arcuate surface (122A) of the lower channel (121A). The sliding surfaces (223) are formed on opposite sides of the lower slider (22) and slidably abut respectively with the walls (123) in the lower channel (121A). The hemispheric protrusion (222) is formed on the top of the lower slider (22) and is rotatably received in the hemispheric recess (212) in the upper slider (21). The positions of the upper slider (21) and the lower slider (22) can exchange each other.

Figure 3:
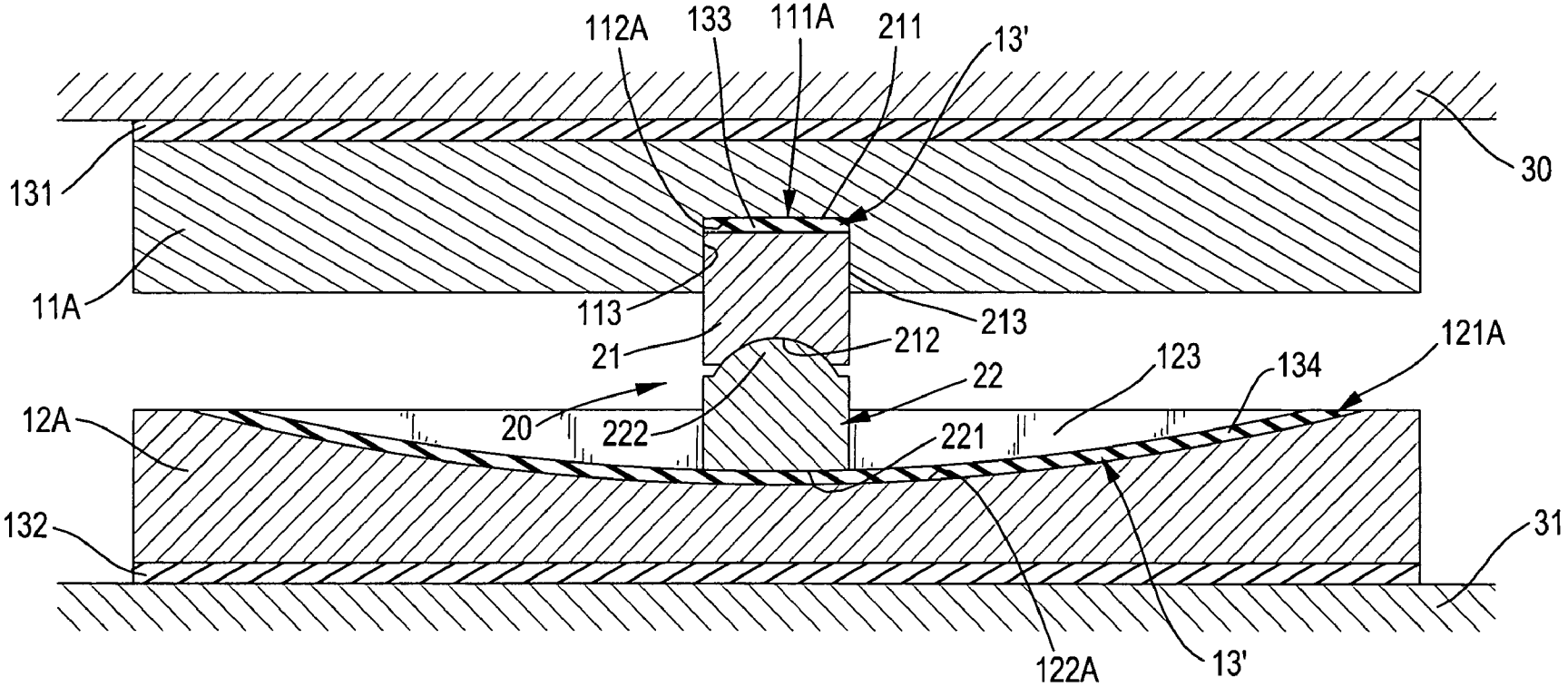
FIG. 3 is a cross sectional side plan view of a second embodiment of a shock suppressor in accordance with the present invention.

The shock suppressing element (13) is mounted on one of the upper base (11A), the lower base (12A) and the connecting device (20). In the first embodiment, the shock suppressing element (13) comprises a top coating layer (131) attached to the top of the upper base (11A) and a bottom coating layer (132) attached to the bottom of the lower base (12A). With reference to FIG. 3, the shock suppressing element (13') further comprises an upper channel coating layer (133) attached to the arcuate face (112A) of the upper channel (111A) and a lower channel coating layer (134) attached to the arcuate surface (122A) of the lower channel (121A).

In such an arrangement, with reference to FIGS. 1 to 3, the lower base (12A) will move with the ground (31) when an earthquake occurs. The upper slider (21) and the lower slider (22) of the connecting device (20) will move respectively along the upper and lower channels (111A,121A) with shock along the first and second directions to keep the upper base (11A) from movement. Consequently, the shocks along the first and second directions can be reduced and dissipated. Furthermore, with the engagement between the hemispheric recess (212) and protrusion (222) on the sliders (21,22), shock along other direction beside the first and second directions can also be efficiently reduced. Accordingly, a horizontal shock with multiple directions can be efficiently reduced or dissipated so that the shock will not be transmitted to the building (30) supported on the shock suppressor (10). In addition, with the arrangement of the shock suppressing element (13,13'), vertical shock can also be efficiently suppressed.

When the shock has stopped, the arcuate abutment between the sliders (21,22) and the arcuate face and surface (112A, 122A) of the channels (111A,121A) will automatically move the sliders (21,22) to an original position due to the weight of the elements and the supported object, such that the shock suppressor (10) has an automatic return positioning effect to an original status.

Figure 4:
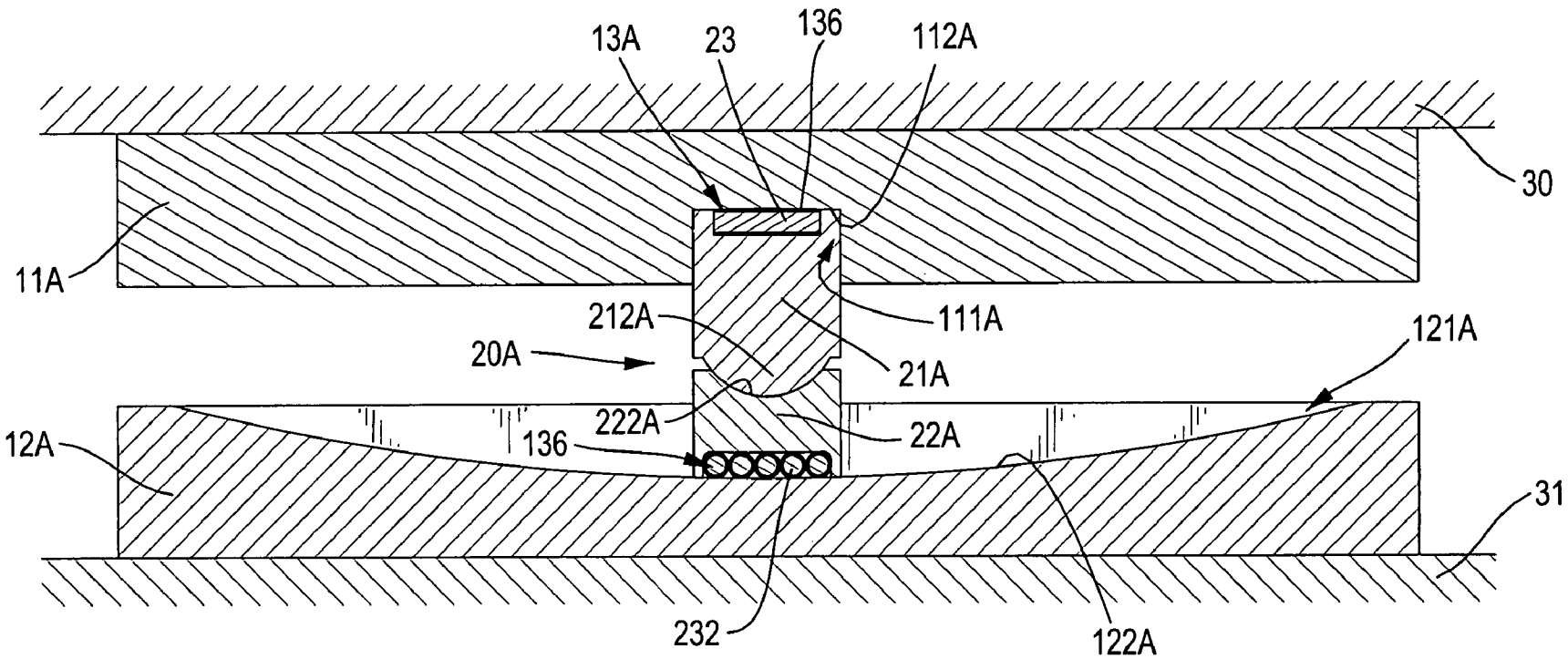
FIG. 4 is a cross sectional side plan view of a third embodiment of a shock suppressor in accordance with the present invention.

With reference to FIG. 4, in a third embodiment, the upper slider (21A) of the connecting device (20A) has a hemispheric protrusion (212A) formed on the bottom of the upper slider (21A). The lower slider (22A) of the connecting device (20A) has a hemispheric recess (222A) defined in the top of the lower slider (22A) and rotatably receiving the hemispheric protrusion (212A) on the upper slider (21A). The connecting device (20A) further comprises multiple first rotating elements (23,232) mounted between the upper slider (21A) and the upper channel (111A) and between the lower slider (22A) and the lower channel (121A). The shock suppressing element (13A) comprises multiple coating layers (136) attached to the first rotating elements (23,232). In a preferred mbodiment, each first rotating element (23,232) is a roller (23) or a ball (232).

Figure 5:
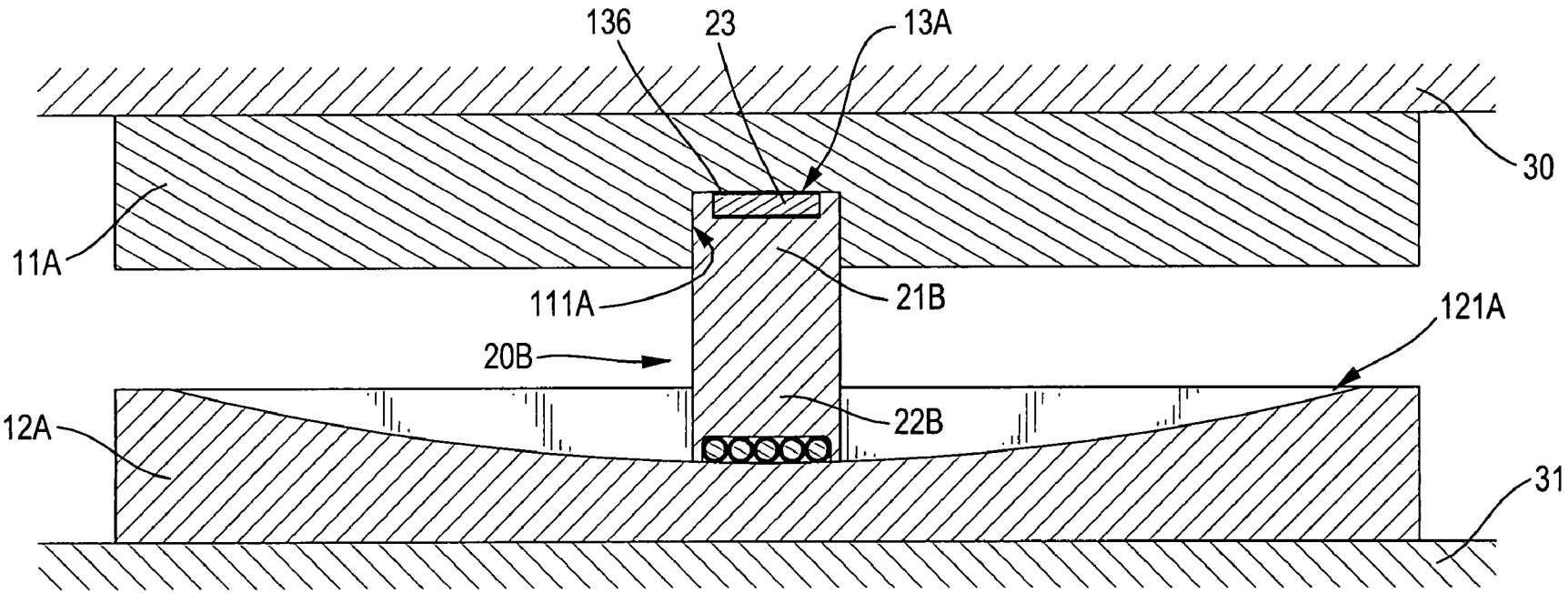
FIG. 5 is a cross sectional side plan view of a fourth embodiment of a shock suppressor in accordance with the present invention.

With reference to FIG. 5, in a fourth embodiment, the upper slider (21B) of the connecting device (20B) is integrally combined with the lower slider (22B).

Figure 6:
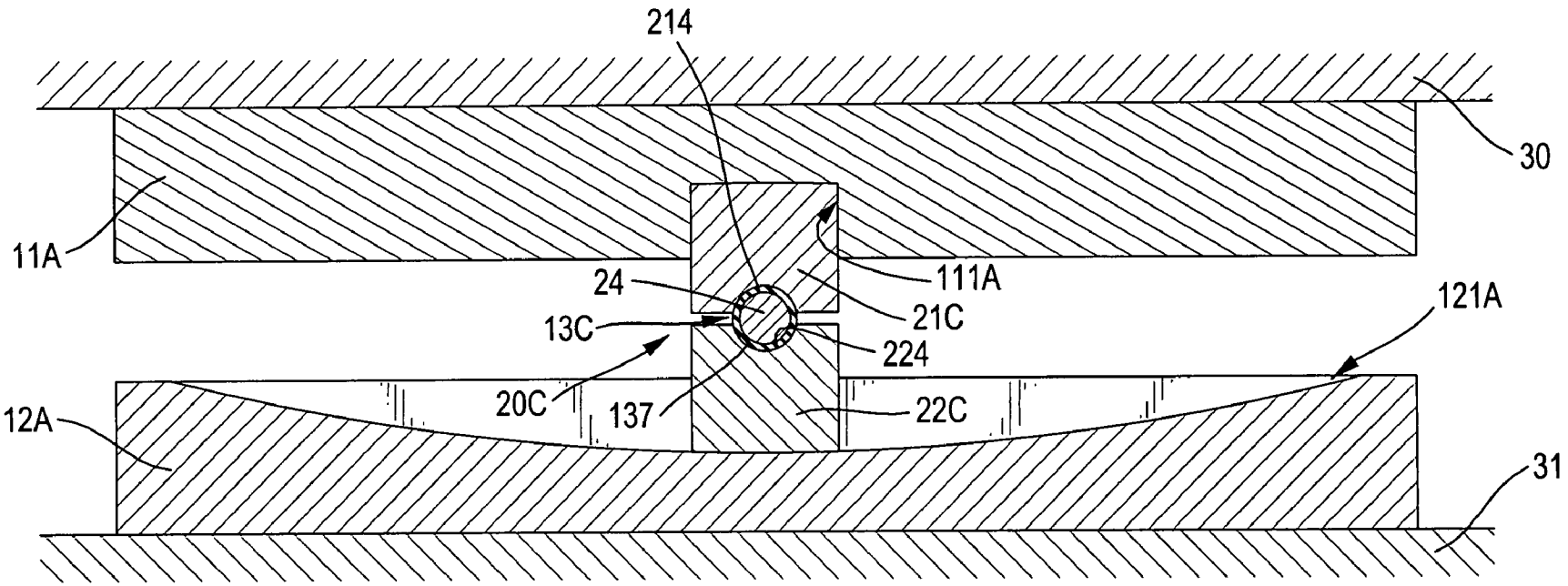
FIG. 6 is a cross sectional side plan view of a fifth embodiment of a shock suppressor in accordance with the present invention.

With reference to FIG. 6, in a fifth embodiment, the upper slider (21C) of the connecting device (20C) has a recess (214) defined in the lower of the upper slider (21C). The lower slider (22C) has a recess (224) defined in the top of the lower slider (22C) and corresponding to the recess (214) in the upper slider (21C). The connecting device (20C) further has at least one second rotating element (24) rotatably mounted inside the recesses (214,224) in the upper and lower sliders (21C, 22C). In a preferred embodiment, one second rotating element (24) is rotatably mounted inside the recesses (214,224) and is a ball. The shock suppressing element (13C) is at least one coating layer (137) attached to the at least one second rotating element (24).

Figure 7:
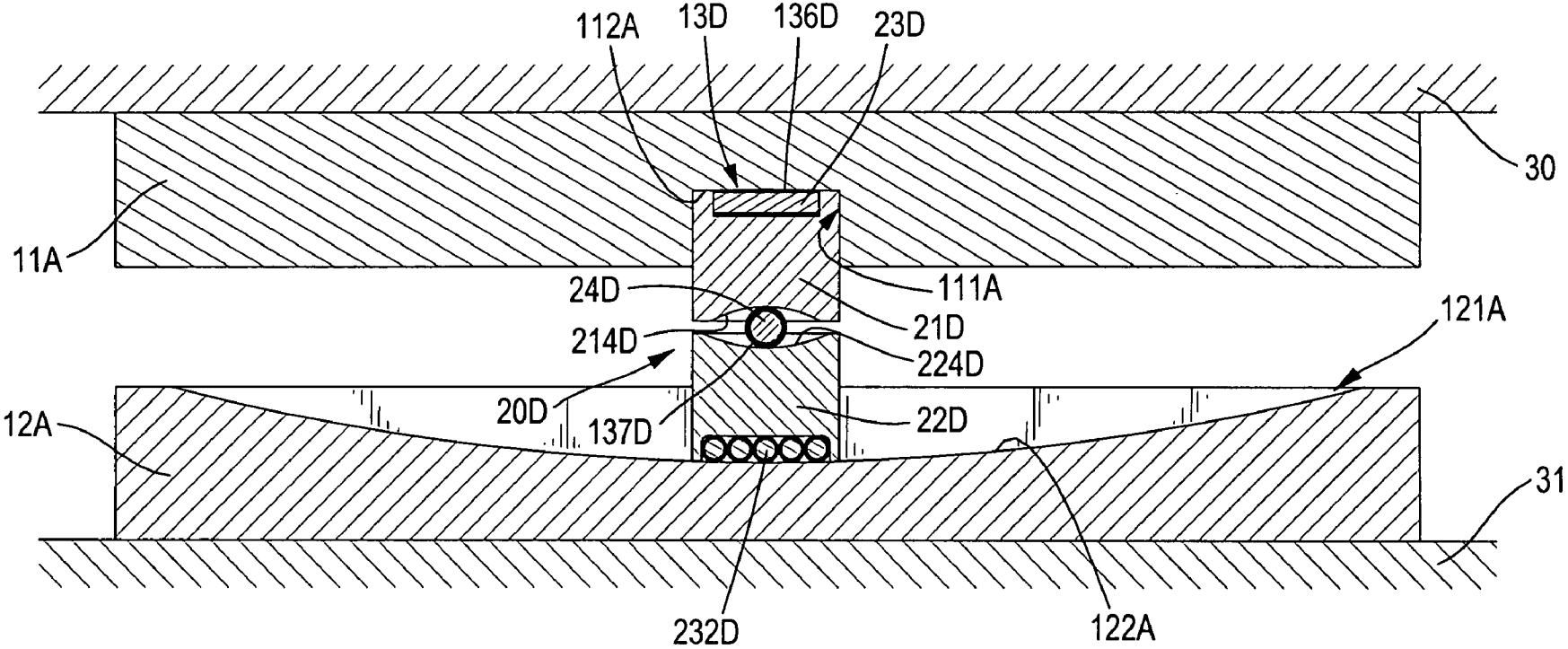
FIG. 7 is a cross sectional side plan view of a sixth embodiment of a shock suppressor in accordance with the present invention.

With reference to FIG. 7, in a sixth embodiment, the upper slider (21D) of the connecting device (20D) has a recess (214D) defined in the bottom of the upper slider (21D). The lower slider (22D) has a recess (224D) defined in the top of the lower slider (22D) and corresponding to the recess (214D) in the upper slider (21D). The connecting device (20D) further has multiple first rotating elements (23D,232D) and at least one second rotating element (24D). The first rotating elements (23D,232D) are mounted between the upper slider (21D) and the upper channel (111A) and between the lower slider (22D) and the lower channel (121A). In a preferred embodiment, each first rotating element (23D,232D) is a roller (23D) or a ball (232D). The at least one second rotating element (24D) is rotatably mounted inside the recesses (214D,224D) in the upper and lower sliders (21D,22D). The shock suppressing element (13D) comprises multiple coating layers (136D,137D) attached to the first and second rotating elements (23D,232D,24D).

Figure 8:
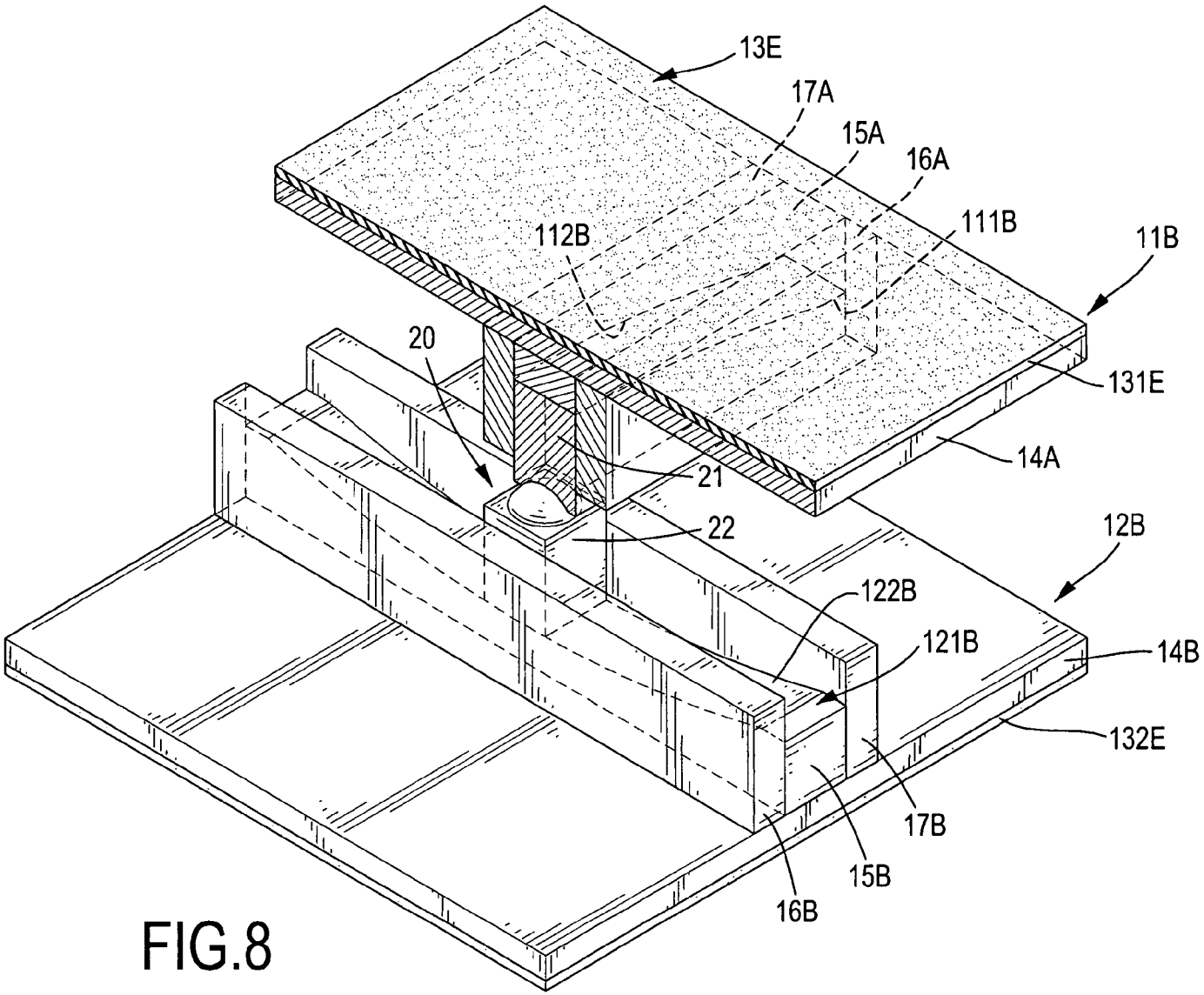
FIG. 8 is a perspective view in partial cross section of a seventh embodiment of a shock suppressor in accordance with the present invention.

With reference to FIG. 8, in a seventh embodiment, the upper base (11B) comprises a top plate (14A), an upper block (15A) and two upper side blocks (16A,17A). The top plate (14A) has a top and a bottom. The upper block (15A) is attached to the bottom of the top plate (14A) and has an arcuate face (112B). The upper side blocks (16A,17A) are attached to the bottom of the top plate (14A) at two sides of the upper block (15A) to define the upper channel (111B) between the arcuate face (112B) of the upper block (15A) and the upper side blocks (16A,17A)

The lower base (12B) comprises a lower plate (14B), a lower block (15B) and two lower side blocks (16B,17B). The bottom plate (14B) has a top and a bottom. The lower block (15B) is attached to the top of the bottom plate (14B) and has an arcuate top (122B). The lower side blocks (16B,17B) are attached to the top of the bottom plate (14B) at two sides of the lower block (15B) to define the lower channel (121B) between the arcuate top (122B) of the lower block (15B) and the lower side blocks (16B,17B).

The connecting device (20) comprises an upper slider (21) and a lower slider (22) and is same as the first embodiment, such that the detail of the connecting device (20) is omitted. The shock suppressing element (13E) comprises a top coating layer (131E) attached to the top of the top plate (14A) and a lower coating layer (132E) attached to the lower of the lower plate (14B).

With such a shock suppressor (10) in accordance with the present invention, shock energy transmitted in multiple directions can be dissipated efficiently.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shock suppressor comprising:

an upper base having a bottom and an upper channel defined in the bottom along a first direction;

a lower base corresponding to the upper base and having a top and a lower channel defined in the top along a second direction corresponding to the first direction of the upper channel at an angle; and a connecting device slidably mounted in the upper channel and the lower channel, wherein the upper channel has an arcuate face and two walls perpendicular to the arcuate face and facing each other;

the lower channel has an arcuate surface and two walls perpendicular to the arcuate surface of the lower channel and facing each other; and the connecting device comprises an upper slider slidably mounted inside the upper channel and having a bottom protruding out from the upper channel, an arcuate sliding top slidably coupled to the arcuate face of the upper channel, and two sliding surfaces formed on opposite sides of the upper slider and slidably abutting and directly contacting with the two walls of the upper channel all the time; and a lower slider slidably mounted inside the lower channel and having a top protruding out from the lower channel and connected to the bottom of the upper slider, an arcuate sliding bottom slidably coupled to the arcuate surface of the lower channel, and two sliding surfaces formed on opposite sides of the lower slider and slidably abutting and directly contacting with the walls in the lower channel all the time.

2. The shock suppressor as claimed in claim 1 further comprising a shock suppressing element mounted on at least one of the upper base, the lower base and the connecting device.

3. The shock suppressor as claimed in claim 2, wherein the connecting device further comprises multiple first rotating elements mounted between the upper slider and the upper channel and between the lower slider and the lower channel.

4. The shock suppressor as claimed in claim 3, wherein the upper slider has a hemispheric recess defined in the bottom of the upper slider; and the lower slider has a hemispheric protrusion formed on the top of the lower slider and rotatably received in the hemispheric recess in the upper slider.

5. The shock suppressor as claimed in claim 3, wherein the upper slider has a hemispheric protrusion formed on the bottom of the upper slider; and the lower slider has a hemispheric recess defined in the top of the lower slider and rotatably receiving the hemispheric protrusion on the upper slider.

6. The shock suppressor as claimed in claim 3, wherein the upper slider is integrally combined with the lower slider.

7. The shock suppressor as claimed in claim 3, wherein the upper slider has a recess defined in the bottom of the upper slider;

the lower slider has a recess defined in the top of the lower slider and corresponding to the recess in the upper slider; and at least one second rotating element is rotatably mounted inside the recesses in the upper and lower sliders.

8. The shock suppressor as claimed in claim 7, wherein the shock suppressing element is at least one coating layer attached to the at least one second rotating element.

9. The shock suppressor as claimed in claim 7, wherein each one of the at least one second rotating element is a ball.

10. The shock suppressor as claimed in claim 3, wherein the shock suppressing element is multiple coating layers attached to the first rotating elements.

11. The shock suppressor as claimed in claim 3, wherein each first rotating element is a roller.

12. The shock suppressor as claimed in claim 3, wherein each first rotating element is a ball.

13. The shock suppressor as claimed in claim 2, wherein the shock suppressing element is a coating layer attached to the arcuate face of the upper channel.

14. The shock suppressor as claimed in claim 2, wherein the shock suppressing element is a coating layer attached to the arcuate surface of the lower channel.

15. The shock suppressor as claimed in claim 1, wherein the upper slider has a hemispheric recess defined in the bottom of the upper slider; and the lower slider has a hemispheric protrusion formed on the top of the lower slider and rotatably received in the hemispheric recess in the upper slider.

16. The shock suppressor as claimed in claim 1, wherein the upper slider has a hemispheric protrusion formed on the bottom of the upper slider; and the lower slider has a hemispheric recess defined in the top of the lower slider and rotatably receiving the hemispheric protrusion on the upper slider.

17. The shock suppressor as claimed in claim 1, wherein the upper slider has a recess defined in the bottom of the upper slider;

the lower slider has a recess defined in the top of the lower slider and corresponding to the recess in the upper slider; and at least one second rotating element is rotatably mounted inside the recesses in the upper and lower sliders.

18. The shock suppressor as claimed in claim 17, wherein the shock suppressing element is at least one coating layer attached to the at least one second rotating element.

19. The shock suppressor as claimed in claim 17, wherein each one of the at least one second rotating element is a ball.

20. The shock suppressor as claimed in claim 1, wherein the upper base comprises a top plate having a top and a bottom;

an upper block attached to the bottom of the top plate and having an arcuate face to form as the arcuate face of the upper channel; and two upper side blocks attached to the bottom of the top plate at two sides of the upper block to define the upper channel between the arcuate face of the upper block and the upper side blocks;

the lower base comprises a bottom plate having a top and a bottom;

a lower block attached to the top of the bottom plate and having an arcuate top to form as the arcuate face of the lower channel; and two lower side blocks attached to the top of the bottom plate of the lower base at two sides of the lower block to define the lower channel between the arcuate top of the lower block and the lower side blocks.

21. The shock suppressor as claimed in claim 20, wherein the upper slider has a hemispheric recess defined in the bottom of the upper slider; and the lower slider has a hemispheric protrusion formed on the top of the lower slider and rotatably received in the hemispheric recess in the upper slider.

22. The shock suppressor as claimed in claim 20, wherein the upper slider has a hemispheric protrusion formed on the bottom of the upper slider; and the lower slider has a hemispheric recess defined in the top of the lower slider and rotatably receiving the hemispheric protrusion on the upper slider.

23. The shock suppressor as claimed in claim 20 further comprising a shock suppressing element mounted on one of the upper base, lower base and the connecting device.

24. The shock suppressor as claimed in claim 20, wherein the shock suppressing element comprises a top coating layer attached to the top of the top plate and a bottom coating layer attached to the bottom of the bottom plate.

* * * * *